US007412948B2

(12) United States Patent
Pipkorn et al.

(10) Patent No.: US 7,412,948 B2
(45) Date of Patent: Aug. 19, 2008

(54) FLUID VALVE

(75) Inventors: Nicholas T. Pipkorn, Gladstone, MI (US); David J. Allen, Gladstone, MI (US); Mark S. Bader, Gladstone, MI (US); Stephen J. Shiverski, Perronville, MI (US)

(73) Assignee: EMP Advanced Development, LLC, Escanaba, MI (US)

( * ) Notice: Subject to any disclaimer, the term of this patent is extended or adjusted under 35 U.S.C. 154(b) by 62 days.

(21) Appl. No.: 11/399,901

(22) Filed: Apr. 7, 2006

(65) Prior Publication Data

US 2007/0234978 A1 Oct. 11, 2007

(51) Int. Cl.
*F01P 7/14* (2006.01)

(52) U.S. Cl. ..... 123/41.1; 123/41.08; 236/34.5; 137/625.46

(58) Field of Classification Search ..... 123/41.01, 123/41.06, 41.08, 41.02, 41.1; 137/625.46
See application file for complete search history.

(56) References Cited

U.S. PATENT DOCUMENTS 3,124,162 A 3/1964 Cameron
3,369,565 A * 2/1968 Haggard, Jr. ..... 137/625.11
5,529,026 A 6/1996 Kurr et al.
5,913,329 A * 6/1999 Haynes et al. ..... 137/338
5,950,576 A 9/1999 Busato et al.
6,164,248 A * 12/2000 Lehmann ..... 123/41.1
6,289,913 B1 * 9/2001 Babin ..... 137/15.18
6,371,060 B1 4/2002 Lehmann et al.
6,539,899 B1 4/2003 Piccirilli et al.
6,601,593 B2 * 8/2003 Deiss et al. ..... 134/25.2
6,688,333 B2 2/2004 McLane et al.
6,920,845 B2 * 7/2005 Lelkes et al. ..... 123/41.01
7,047,986 B2 * 5/2006 Ertle et al. ..... 134/56 D
7,182,101 B2 * 2/2007 Alacqua et al. ..... 137/875
2002/0179165 A1 12/2002 Hu et al.
2003/0217775 A1 11/2003 Cousineau et al.
2005/0034688 A1 2/2005 Lelkes et al.

* cited by examiner

*Primary Examiner*—Stephen K. Cronin
*Assistant Examiner*—Hyder Ali
(74) *Attorney, Agent, or Firm*—Brooks Kushman P.C.

(57) ABSTRACT

A fluid valve for use in proportioning/mixing fluid between at least one input and at least one output. The fluid valve including a rotary actuated diverter for controlling fluid flow between the inlet(s) and outlet(s). The fluid valve may be configured to support proportioning any number of fluids, including liquids and gases, for any number of applications, including automotive and industrial applications.

28 Claims, 4 Drawing Sheets

FLUID VALVE

BACKGROUND OF THE INVENTION

1. Field of the Invention

The present invention relates to fluid valves.

2. Background Art

Fluid valves proportion fluid between one or more inlets and one or more outlets. Fluid valves may include a diverter or other feature within a housing defining a fluid flow path between the inlet(s) and outlet(s). Fluid valves can be used to proportion any number of fluids, including liquids and gases. Fluid valves are operable in any number of environments, including industrial and automotive environments.

SUMMARY OF THE INVENTION

One non-limiting aspect of the present invention relates to a fluid valve having a rotary actuated diverter configured to proportion fluid flow between one or more inlets and one or more outlets.

One non-limiting aspect of the present invention relates to a fluid valve configured to proportion fluid flow entering a housing radially and exiting the housing axially.

One non-limiting aspect of the present invention relates to a fluid valve having a floating diverter configured to float with fluid flow pressure.

One non-limiting aspect of the present invention relates to a cooling system for use with an engine. The cooling system may include a radiator, a radiator bypass, and a fluid valve in communication with the engine, radiator, and radiator bypass. The fluid valve may be controllable to proportion coolant flow from the engine to one or both of the radiator and radiator bypass in order to control engine cooling.

The fluid valve may include an axially elongated housing having an inlet for receiving coolant flow from the engine and separate outlets for outputting coolant flow to the radiator and radiator bypass. The outlets may be located at a common face of the housing and the inlet may be located upstream from the outlets and radially thereto such that the outlets are along the longitudinal axis of the housing and the inlet is along the radial axis of the housing whereby coolant must travel radially and then axially within the housing along a fluid flow path defined from the inlet to the face having the outlets. The fluid valve may include a rotary actuated diverter within the fluid flow path and configured to rotate axially about the longitudinal axis of the housing and relative to the face of the housing so as to selectively cover the outlets and thereby proportion fluid flow between the inlet and outlets associated with the radiator and radiator bypass.

The diverter may be located upstream from the face and downstream from the inlet such that fluid flow pressure causes the diverter to compress against the face of the housing. The diverter may be disc shaped and include a covered portion and open portion, wherein the covered portion is rotary positionable to close one or more of the outlets and the open portion is rotary positionable to open one or more of the outlets. Optionally, the outlets may be arranged and the open portion may be shaped such that the open portion only opens one of the outlets at a time, regardless of the radial positioning of the diverter relative to the outlets.

The fluid valve may further include an electric motor configured for controllably rotating the diverter. The diverter may be connected to the motor in such a manner as to permit rotation of the motor to cause rotation of the diverter. The diverter may be axially mounted to a shaft connected to the motor such that the shaft rotates with rotation of the motor.

The diverter may be free to travel axially along the shaft such that fluid flow pressure moves the diverter to compress against the face of the housing. The fluid valve may include a spring to position the diverter downstream from the inlet.

The fluid valve may include a fail-safe release mechanism to rotate the diverter such that the open portion opens the outlet associated with the radiator if power is lost to the electric motor. The fail-safe release mechanism may be a spring.

One non-limiting aspect of the present invention relates to a cooling system for use with an engine. The cooling system may include a radiator, a radiator bypass, and a fluid valve in communication with the engine, radiator, and radiator bypass. The fluid valve may be controllable to proportion coolant flow from the engine to one or both of the radiator and radiator bypass. The fluid valve may include a housing having an inlet for receiving coolant flow from the engine and separate outlets for outputting coolant flow to the radiator and radiator bypass. The outlets may be located at a common face of the housing and the inlet located upstream from the outlets. The fluid valve may include a floating rotary actuated diverter configured to float with fluid flow pressure against the face. The diverter may be configured to rotate relative to the face of the housing so as to selectively cover the outlets and thereby proportion fluid flow between the inlet and outlets associated with the radiator and radiator bypass.

The system may further include an electric motor configured to rotate a shaft, the diverter being mounted to the shaft such that the shaft rotates the diverter to selectively cover the outlets as a function of movement of the motor. A fail-safe feature may be included and configured to orientate the diverter to open the radiator if power is lost to the electric motor. An alignment feature may be included and configured to position the floating diverter downstream of the inlet.

One non-limiting aspect of the present invention relates to a fluid valve. The fluid valve may include an axially elongated housing having at least one inlet for receiving fluid flow and at least one outlet for outputting fluid. The outlet may be located at a face of the housing and the inlet located upstream from the outlet and radially thereto such that the outlet is along the longitudinal axis of the housing and the inlet is along the radial axis of the housing whereby fluid must travel radially and then axially within the housing along a fluid flow path defined from the inlet to the face having the outlet. The fluid valve may further include a rotary actuated diverter within the fluid flow path and configured to rotate axially about the longitudinal axis of the housing and relative to the face of the housing so as to selectively cover the outlet and thereby proportion fluid flow between the inlet and outlet.

One non-limiting aspect of the present invention relates to a fluid valve. The fluid valve may include a housing having at least one inlet for receiving fluid and at least one outlet for outputting the fluid. The outlet may be located at a face of the housing and the inlet located upstream from the outlet. The fluid valve may further include a floating rotary actuated diverter configured to float with fluid flow pressure against the face. The diverter may be configured to rotate axially about the longitudinal axis of the housing and relative to the face of the housing so as to selectively cover the outlet and thereby proportion fluid flow between the inlet and outlet.

The above features and advantages, along with other features and advantages of the present invention, are readily apparent from the following detailed description of the invention when taken in connection with the accompanying drawings.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION OF THE PREFERRED EMBODIMENT(S)

Figure 1:
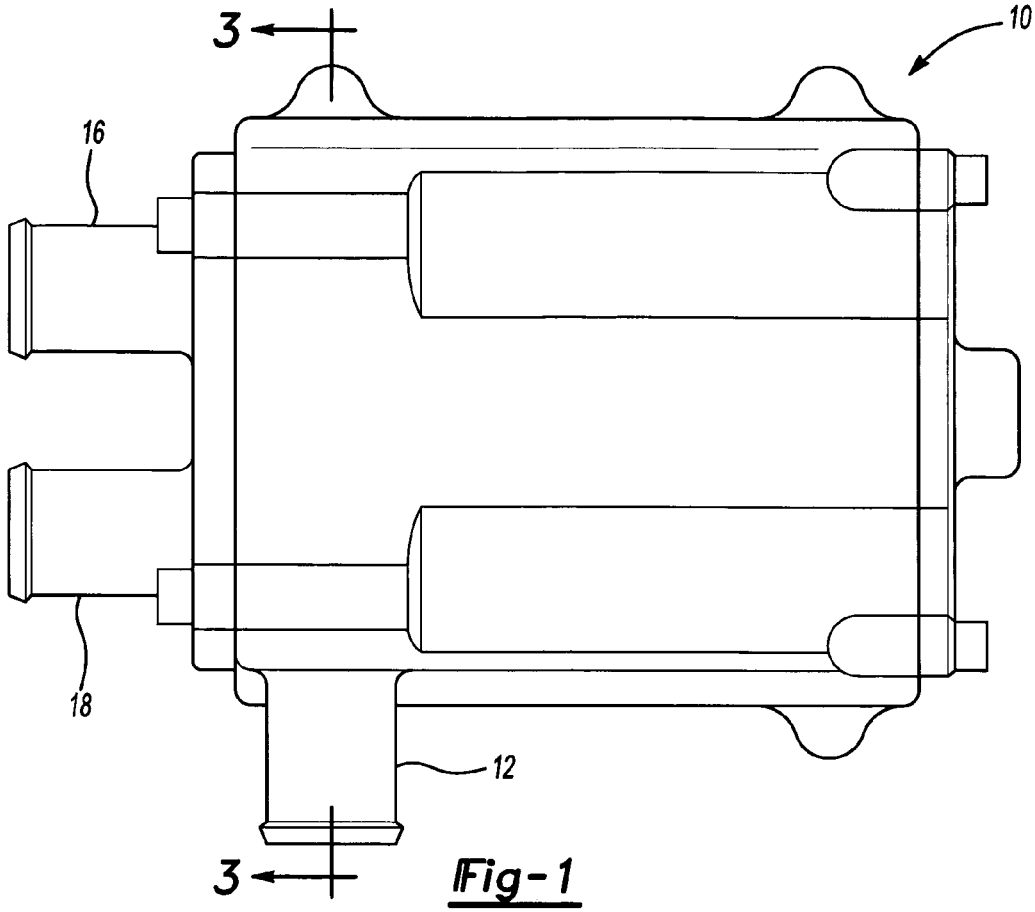
FIGS. 1-2 illustrate a fluid valve in accordance with one non-limiting aspect of the present invention.
Figure 2:
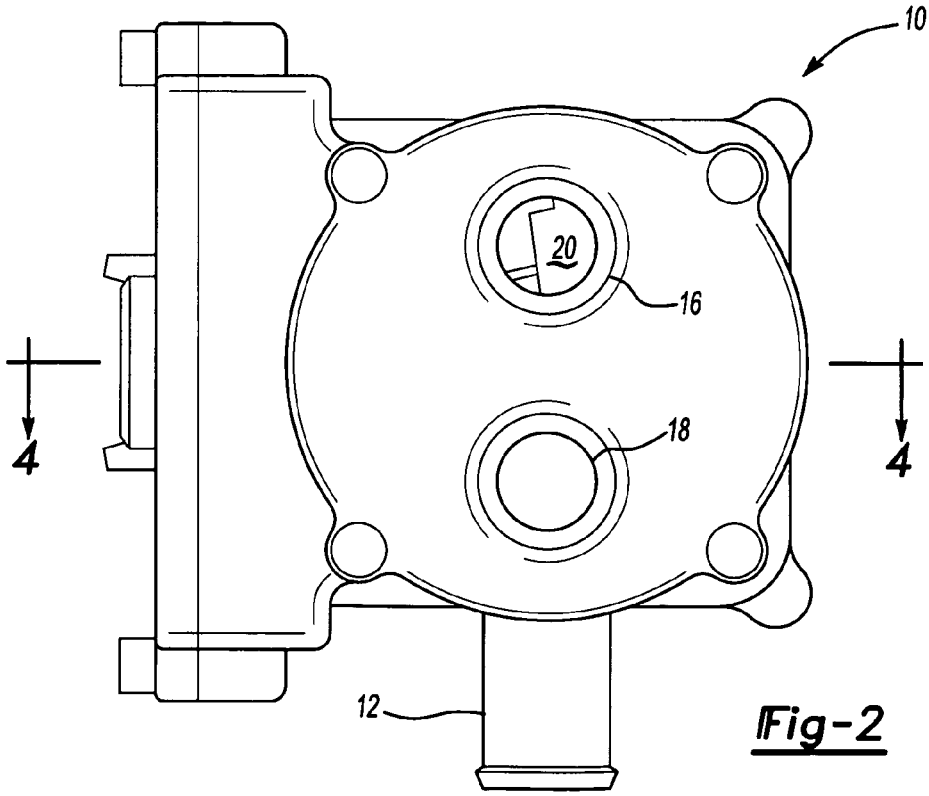

FIGS. 1-2 illustrate a fluid valve 10 in accordance with one non-limiting aspect of the present invention. The fluid valve 10 is configured to proportion or otherwise control fluid flow therethrough. The fluid valve 10 may include any number of inlets and outlets for respectively receiving and outputting fluid. The fluid valve may proportion any number of fluids, including liquids, gases, or some combination thereof.

For exemplary purposes, the fluid valve 10 is shown to include one inlet 12 and two separate outlets 16-18 such that fluid may be proportioned from the inlet 12 to either outlet 16-18. As shown in FIG. 2, the fluid valve 10 includes a diverter 20 to control fluid flow by selectively covering the outlets 16-18. FIG. 2 illustrates the diverter 20 partially covering a first outlet 16 and completely covering a second outlet 18 such that fluid is proportioned from the inlet 12 to the first outlet 16.

Of course, the present invention is not so limited and fully contemplates the fluid valve 10 having any number of inlets and outlets. Optionally, as described below in more detail, the inlet(s) are located upstream from the diverter 20 and the outlet(s) are located downstream from the diverter such that the diverter 20 is free to float in the direction of fluid flow through the fluid valve 10.

Figure 3A:
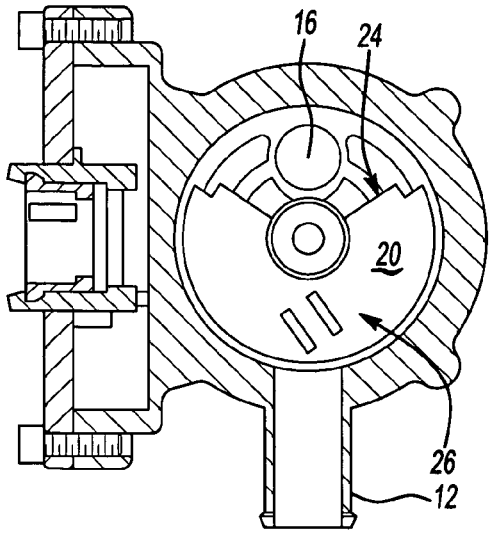
FIGS. 3*a*-3*c* illustrate a cross-sectional view of the fluid valve taken along line 3-3 in accordance with one non-limiting aspect of the present invention.
Figure 3B:
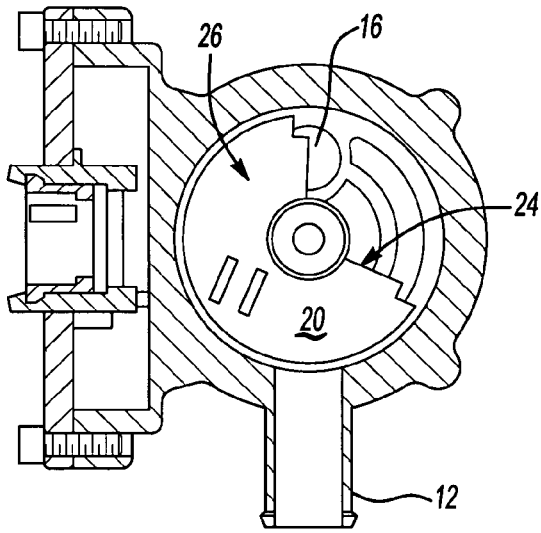
Figure 3C:
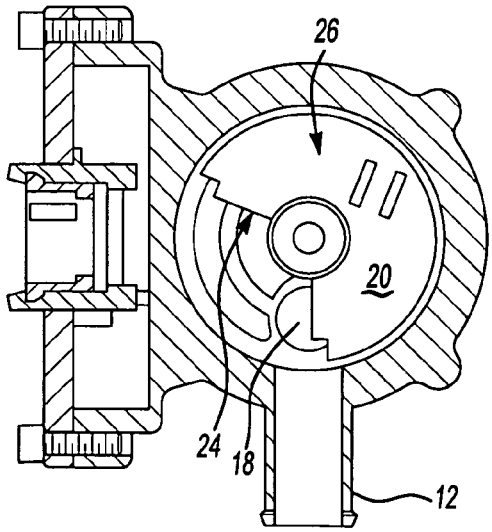

FIGS. 3*a*-3*c* illustrate a cross-sectional view of the fluid valve 10 taken along line 3-3 in accordance with one non-limiting aspect of the present invention. The cross-sectional view illustrates multiple proportioning positions of the diverter 20 in accordance with one non-limiting aspect of the present invention. The diverter 20 may be disc shaped and configured to include an open portion 24 and a closed portion 26. These portions may be positioned relative the outlets 16-18 to cover and uncover the same.

FIGS. 3*a*-3*c* respectively illustrate completely opening the first outlet 16 and covering the second outlet 18, partially opening the first outlet 16, and partially opening the second outlet 18. As shown, the outlets 16-18 and diverter 20 are configured such that fluid is unable to flow simultaneously from both outlets 16-18. The present invention, however, is not so limited and fully contemplates the diverter 20 having any number of configurations and shapes to simultaneously proportion fluid flow from one or more of the outlets 16-18.

Figure 4:
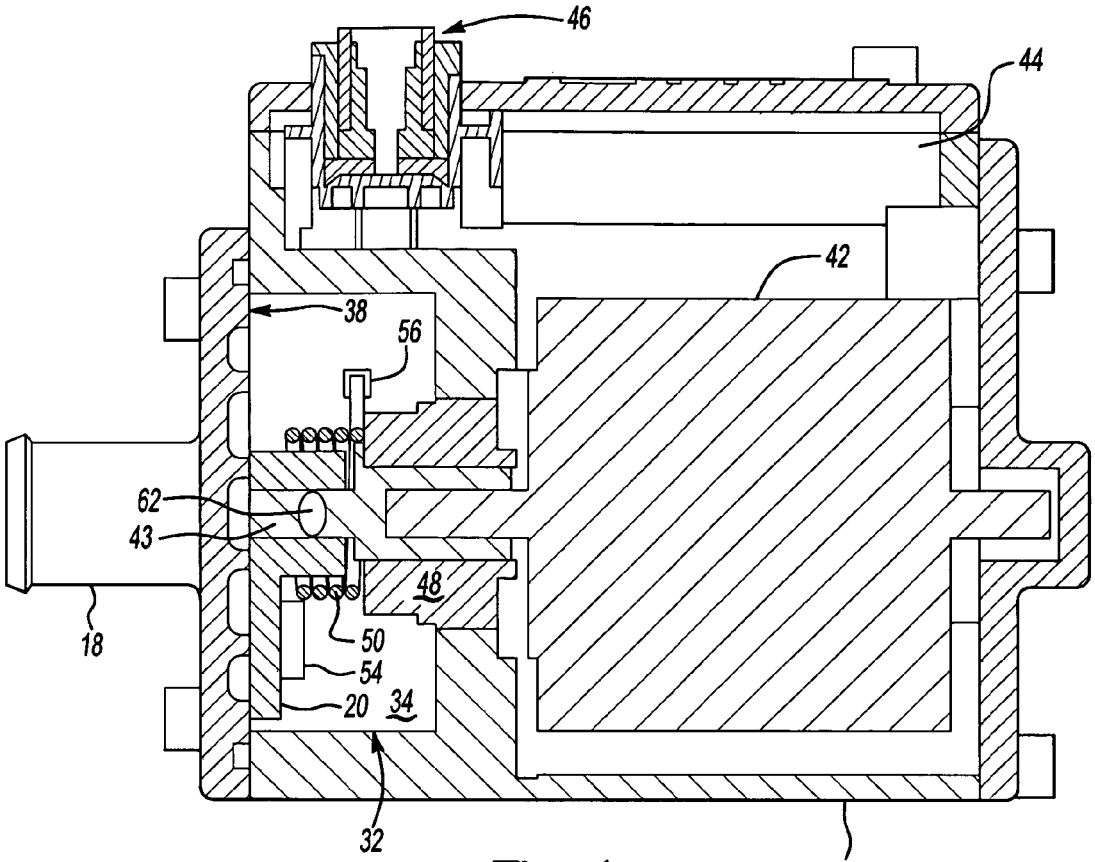
FIG. 4 illustrates a cross-sectional view of the fluid valve taken along line 4-4 in accordance with one non-limiting aspect of the present invention.

FIG. 4 illustrates a cross-sectional view of the fluid valve 10 taken along line 4-4 in accordance with one non-limiting aspect of the present invention. As shown, the fluid valve 10 may include an axially elongated housing 30 having an annular proportioning portion 32. The proportioning portion 32 includes a cavity 34 for defining a fluid flow path from the inlet 12 to a face 38 associated with the outlets 16-18. The diverter 20 is positioned downstream from the inlet 12 and upstream of the outlets 16-18 within the fluid flow path. The fluid enters radially through the inlet 12 and then flows axially to the outlets 16-18.

An electric motor 42 may be included to control rotation of the diverter 20. A shaft 43 or other feature may be connected to the motor 42 and the diverter 20 may be mounted thereto such that rotation of the motor 42 causes rotation of the diverter 20. The motor 42 may be a rotary type motor controlled by signals received from a controller 44. The controller 44 may include an adapter 46 or other feature for receiving signals from a control module or other feature (not shown) configured to control/instruct the operation thereof.

A mechanical seal 48 or other sealing feature may be included to seal the shaft 43 and motor 42 from fluid entering from proportioning portion 32. A fail-safe 50 feature may be included to bias the diverter 20 to a selected position should the ability of the motor 42 to position the shaft 43 be lost, such as through loss of torque associated with motor power or other operational interrupt. The fail-safe feature 50, as shown, may be a spring connected between fingers 54-56 on the housing 30 and diverter 20.

Optionally, the diverter 20 is freely mounted to the shaft 43 such that it may float axially along the shaft 43 in the absence of pressure. This may be advantageous in assembling the fluid valve 10 as it permits better tolerances and ease of assembly. The fail-safe feature 50 may apply pressure against the diverter 20 to position it downstream of the inlet 12 and against the face 38. Once so positioned, fluid flow through the inlet 12 then further compresses the diverter 20 against the face 38.

An alignment feature 62 may be included to position the diverter 20 downstream of the inlet 12 along the shaft 43. The alignment feature 62 may be a pin or other feature extending through the shaft 43. This feature can be used to insure proper positioning of the diverter 20 downstream from the inlet 12 if the fail-safe feature 50 is omitted and/or if the fail-safe feature 50 is otherwise unable to properly position the diverter 20.

Figure 5:
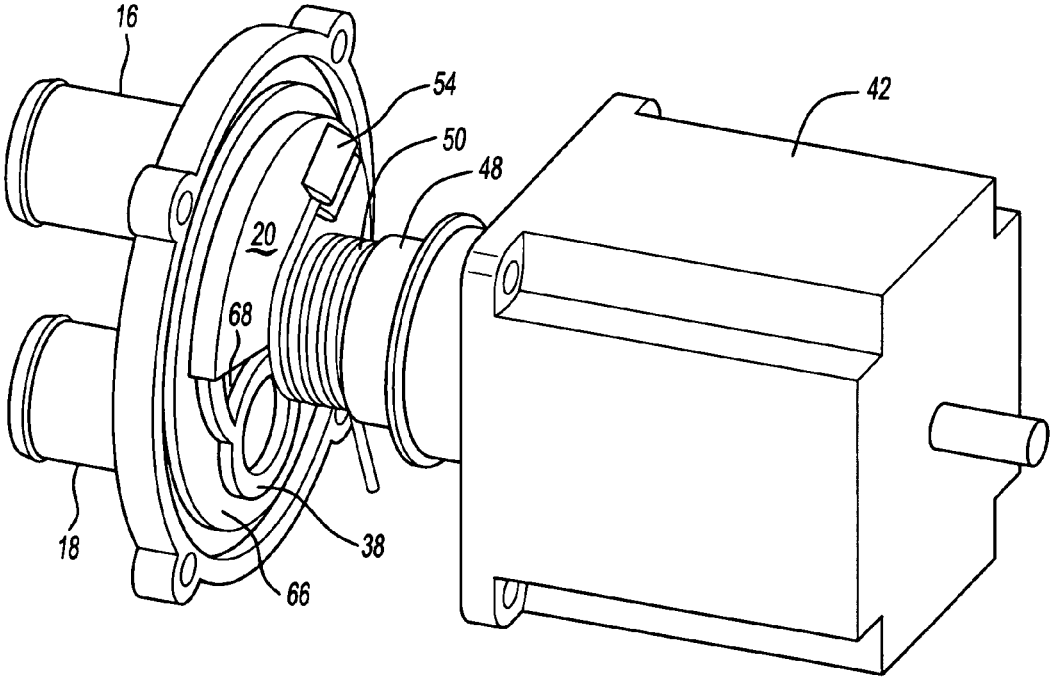
FIG. 5 illustrates a perspective assembly view of the fluid valve in accordance with one non-limiting aspect of the present invention.

FIG. 5 illustrates a perspective assembly view of the face 38, diverter 20, spring 50, seal 48, and electric motor 42 in accordance with one non-limiting aspect of the present invention. The perspective view further illustrates recesses 66-68 within the face 38. The recesses 66-68 limit the amount of surface area of the face 38 compressing against the diverter 20. This can be helpful in limiting the power required of the motor 42 to rotate the diverter 20.

The compressive force of the fluid and spring 50 compress the diverter 20 against the face 38 to seal the outlets 16-18. Such axial sealing can be beneficial in limiting leakage of fluid through any covered outlet 16-18. Should the face 38 wear over time, the compressive forces on the floating diverter 20 cause it to move axially with such wear to maintain the desired sealing.

Figure 6:
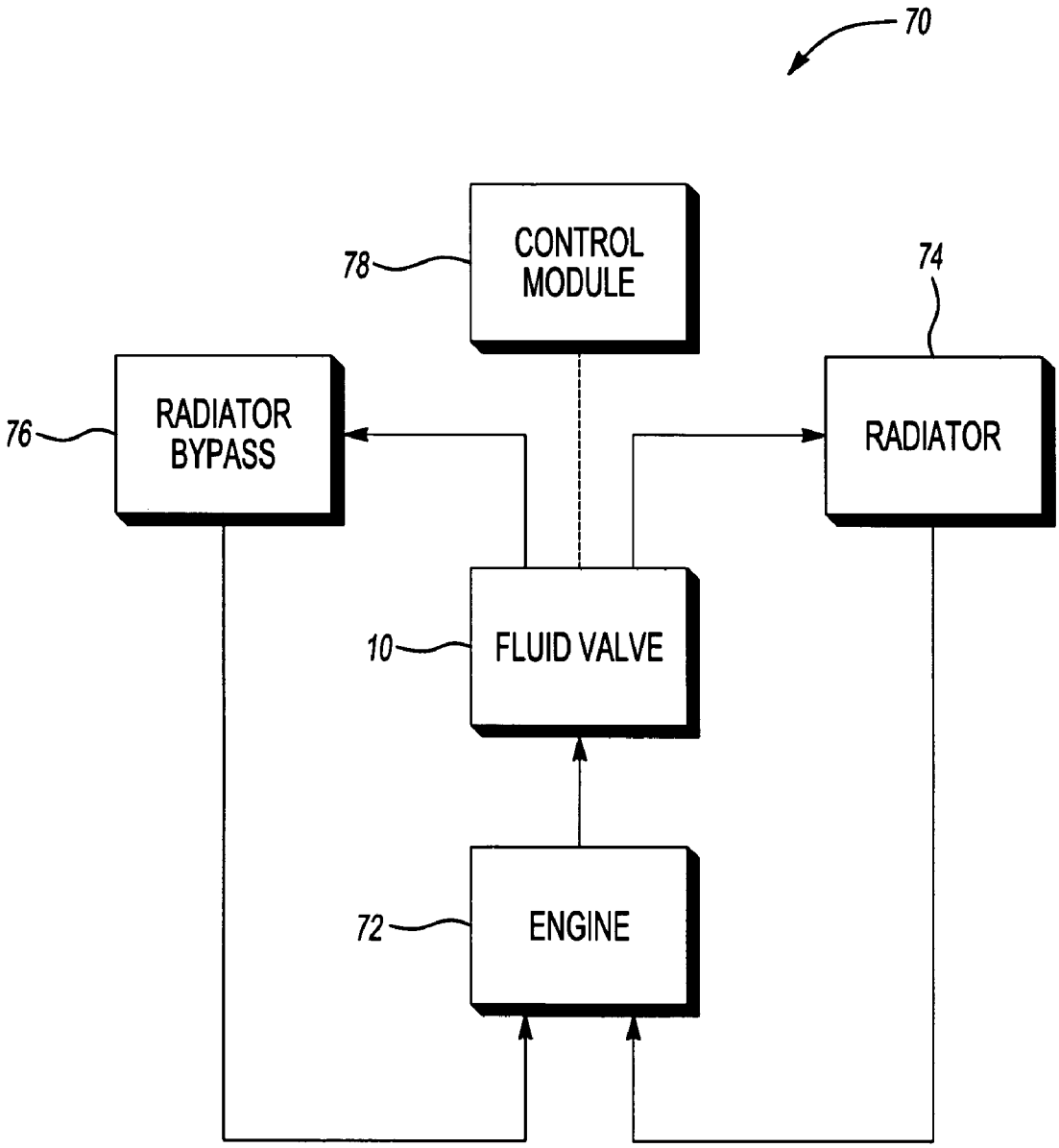
FIG. 6 illustrates a cooling system in accordance with one non-limiting aspect of the present invention.

FIG. 6 illustrates a cooling system 70 in accordance with one non-limiting aspect of the present invention. The cooling system 70 includes the above-described fluid valve 10 for controlling the flow of coolant used to cool an engine 72. The system 70 may include a radiator 74 configured to cool engine coolant and a radiator bypass 76 to bypass the radiator 74 when cooling of the coolant is undesirable.

The fluid valve 10 is positioned downstream of the engine 72 and upstream of the radiator 74 and radiator bypass 76 within the coolant flow path. Ducting and/or other features generally illustrated with leader lines communicate the coolant from one location to another, as one having ordinary skill in the art will appreciate.

In operation, the fluid valve 10 receives coolant from the engine 72 and proportions it to one of the radiator 74 and radiator bypass 76. A vehicle control module 78 may be include to instruct operation of the fluid valve 10 according to any number of cooling strategies.

The present invention fully contemplates other configurations and applications for the fluid valve 10 and/or cooling system 70. In particular, the present invention contemplates the fluid valve 10 including any number of inlets and outlets, with corresponding variations in the fluid valve 10 and diverter 20 to permit rotary proportioning between the various outlets.

With respect to the cooling system 70, for example, the fluid valve 10 may include an additional outlet (not shown) for a heater or other element. The additional outlet may operate in conjunction with diverter 20 positioning relative to the bypass outlet 18 and/or independently thereof so as to facilitate use of the coolant fluid for any number of vehicle operations. Such an additional outlet may include a configuration similar to the illustrated outlets 16-18 such that fluid flows through the additional outlet in a similar manner.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A cooling system for use with an engine, the cooling system comprising:

a radiator;

a radiator bypass; and a fluid valve in communication with the engine, radiator and radiator bypass, the fluid valve being controllable to proportion coolant from the engine to one or both of the radiator and radiator bypass in order to control engine cooling, the fluid valve including:

(i) an axially elongated housing having an inlet for receiving coolant from the engine and separate outlets for outputting coolant to the radiator and radiator bypass, the outlets located at a common face of the housing and the inlet located upstream from the outlets and radially thereto such that the outlets are along the longitudinal axis of the housing and the inlet is along the radial axis of the housing whereby coolant must travel radially and then axially within the housing along a fluid flow path defined from the inlet to the face having the outlets;

(ii) a rotary actuated diverter within the fluid flow path and configured to rotate axially about the longitudinal axis of the housing and relative to the face of the housing so as to selectively cover the outlets and thereby proportion fluid flow between the inlet and outlets associated with the radiator and radiator bypass; and (iii) wherein the common face includes grooves below an outer surface that the diverter contacts.

2. The system of claim 1 wherein the diverter is located upstream from the face and downstream from the inlet such that fluid flow pressure causes the diverter to compress against the face of the housing.

3. The system of claim 1 wherein the diverter is disc shaped and includes a covered portion and open portion, wherein the covered portion is rotatably positionable to close one or more of the outlets and the open portion is rotatably positionable to open one or more of the outlets.

4. The system of claim 3 wherein the outlets are arranged and the open portion of the diverter is shaped such that the open portion only opens one of the outlets at a time, regardless of the radial positioning of the diverter relative to the outlets.

5. The system of claim 1 wherein the fluid valve further includes an electric motor configured for controllably rotating the diverter.

6. The system of claim 5 wherein the diverter is connected to the motor in such a manner as to permit rotation of the motor to cause rotation of the diverter.

7. The system of claim 6 wherein the diverter is axially mounted to a shaft connected to the motor, the shaft rotating with rotation of the motor.

8. The system of claim 7 wherein the diverter is free to travel axially along the shaft such that fluid flow pressure moves the diverter to compress against the face of the housing.

9. The system of claim 8 further comprising a spring to position the diverter downstream from the inlet.

10. The system of claim 1 wherein the fluid valve further includes a fail-safe release mechanism to rotate the diverter such that the open portion opens the outlet associated with the radiator if power is lost to the electric motor.

11. The system of claim 10 wherein the fail-safe release mechanism includes a spring.

12. A cooling system for use with an engine, the cooling system comprising:

a radiator;

a radiator bypass;

an electric motor configured to rotate a shaft; and a fluid valve in communication with the engine, radiator and radiator bypass, the fluid valve being controllable to proportion coolant from the engine to one or both of the radiator and radiator bypass, the fluid valve including:

(i) a housing having an inlet for receiving coolant from the engine and separate outlets for outputting coolant to the radiator and radiator bypass, the outlets located at a common face of the housing and the inlet located upstream from the outlets;

(ii) a floating rotary actuated diverter operatively connected to the shaft so that rotation of the shaft positions the diverter to proportion coolant flow to one or both of the radiator and radiator bypass, wherein the diverter is configured to move axially along the shaft.

13. The system of claim 12 further comprising a fail-safe feature configured to open the radiator if power is lost to the electric motor.

14. The system of claim 12 further comprising an alignment feature configured to position the diverter upstream of the inlet, wherein the diverter moves between the alignment feature and the common face.

15. The system of claim 12 wherein the common face includes grooves.

16. A fluid valve, the valve comprising:

an axially elongated housing having at least one inlet for receiving fluid and at least one outlet for outputting fluid, the outlet located at a face of the housing and the inlet located upstream from the outlet and radially thereto such that the outlet is along the longitudinal axis of the housing and the inlet is along the radial axis of the housing whereby fluid must travel radially and then axially within the housing along a fluid flow path defined from the inlet to the face having the outlet;

a rotary actuated diverter within the fluid flow path and configured to rotate axially about the longitudinal axis of the housing and relative to the face of the housing so as to selectively cover the outlet and thereby proportion fluid flow between the inlet and outlet;

a shaft connected to the diverter, the shaft extending along the longitudinal axis of the housing from the inlet to the outlet such that fluid must flow longitudinally along the shaft before reaching the outlet; and an electric motor that that rotates the shaft to position the diverter relative to the outlet.

17. The valve of claim 16 wherein the diverter is located upstream from the face and downstream from the inlet such that fluid flow pressure causes the diverter to compress against the face of the housing.

18. The valve of claim 16 wherein the diverter is disc shaped and includes a covered portion and open portion, wherein the covered portion is rotatably positionable to cover part or all of the outlet and the open portion is rotatably positionable to open part or all of the outlet.

19. The valve of claim 16 wherein the diverter is free to travel axially along the shaft such that fluid flow pressure moves the diverter to compress against the face of the housing.

20. The valve of claim 19 further comprising a spring to position the diverter downstream from the inlet.

21. The valve of claim 16 wherein the fluid valve further includes a fail-safe release mechanism to rotate the diverter such that the open portion opens at least a portion of the outlet if power is lost to the electric motor.

22. The valve of claim 21 wherein the fail-safe release mechanism includes a spring.

23. The fluid valve of claim 16 wherein the face includes grooves below an outer surface that the diverter contacts.

24. A fluid valve comprising:

a housing having at least one inlet for receiving fluid and at least one outlet for outputting the fluid, the outlet located at a face of the housing and the inlet located upstream from the outlet; and a floating rotary actuated diverter configured to translate axially along a longitudinal axis of shaft that extends across a fluid cavity defined between the inlet and outlet of the housing, the diverter further configured to rotate axially about the longitudinal axis of the housing and relative to the face of the housing so as to selectively cover the outlet and thereby proportion fluid flow between the inlet and outlet.

25. The valve of claim 24 further comprising an electric motor and a shaft connected thereto, the motor configured to rotate the shaft and the diverter being mounted to the shaft such that the shaft rotates the diverter to selectively cover the outlet as a function of movement of the motor.

26. The valve of claim 24 further comprising a fail-safe feature configured to orientate the diverter to open at least a portion of the outlet if power is lost to the electric motor.

27. The valve of claim 24 further comprising an alignment feature configured to position the floating diverter downstream of the inlet.

28. The fluid valve of claim 27 further comprising a spring configured to bias the floating diverter against the face, wherein the diverter is free to float between the outlet and the alignment feature such that a gap forms the outlet and the alignment feature in the absence of the spring.

* * * * *